US006305668B1

(12) United States Patent
Edens

(10) Patent No.: US 6,305,668 B1
(45) Date of Patent: Oct. 23, 2001

(54) COMPACT LIFTER

(76) Inventor: Rudolph R. Edens, 37075 31 Mile Rd., Richmond, MI (US) 48062

( * ) Notice: Subject to any disclaimer, the term of this patent is extended or adjusted under 35 U.S.C. 154(b) by 0 days.

(21) Appl. No.: 09/561,791

(22) Filed: May 1, 2000

(51) Int. Cl.[7] ..... B66F 3/24
(52) U.S. Cl. ..... 254/93 R
(58) Field of Search ..... 254/93 R, 93 HP, 254/30, 89 H, 2 R, 2 B, 2 C; 187/213, 215, 234

(56) References Cited

U.S. PATENT DOCUMENTS 3,946,988 * 3/1976 Kehren ..... 254/93 R
4,323,141 * 4/1982 Ragan et al. ..... 254/93 HP
5,690,315 * 11/1997 Thomas ..... 254/93 R

* cited by examiner

*Primary Examiner*—Robert C. Watson
(74) *Attorney, Agent, or Firm*—Lynn E. Cargill

(57) ABSTRACT

A compact lifter is disclosed which lifts a lifting platen by at least one actuating cylinder with a minimum number of posts or guide shafts to guide the platen as it is being lifted to ensure reliability and reproducibility, each of the posts being received by at least a pair of bearings on each post to hold the post steady and true in position during the lifting operation. The lifter can be in constructed in a two post or a four post configuration, among others. An enclosure is disclosed for completely enclosing the working mechanism to prevent environmental contaminants from entering the workings and damaging the machinery.

16 Claims, 5 Drawing Sheets

40
3
32
34
28
30
26
22
24
3
26
32
38
26
22
26
20
16
16
18
42
38
14
10
14
12

10
42
42
34
40
28
30
32
26
20
24
22
44
26
38
36
18
16
38
14
12

COMPACT LIFTER

TECHNICAL FIELD

This invention relates to a compact lifter, and more particularly to a compact lifter with two guide posts or shafts and first and second linear slide bearings on each of the posts so as to provide improved bearing configurations to substantially prevent deviation from the desired lifting path.

BACKGROUND OF THE INVENTION

Conventional lifter assemblies have included a top mounting plate by two pair of shafts located thereunder in order to extend and retract the mounting plate so as to lift a workpiece into a desired location. These lifter assemblies are used extensively in manufacturing operations, and find special utility in automotive manufacturing operations for lifting automotive workpiece components to facilitate the placement of the workpiece during the manufacturing operation.

In the prior art lifter assemblies, the top mounting plate has a linear actuator cylinder centrally located for lifting the mounting plate, and the pairs of shafts have generally supported base and intermediate plates, where the base plate is slidably attached to a first pair of shafts by a first pair of housings having bearings to slidingly support the shafts, while the intermediate plate is slidably attached to the second pair of shafts by a second set of housings and their respective bearings. This has created three distinct problems for modern manufacturing plants.

First, the prior art lifter assemblies required sufficient physical space for both the upward stroke and the bottom stroke of the lifter plate and rods for the lifter assembly. Although attempts have been made to solve this space problem, see for example U.S. Pat. No. 5,690,315, in which two pair of substantially parallel shafts are provided wherein one pair of shafts has the top mounting plate connected to the top of the shafts, while the bottom of the shafts are connected to a separate cross support member, which is, in turn, connected to yet another set of shafts, bearings and all the other necessary parts. This meant that the '315 compact lifter assembly did not require the shafts connected to the top mounting plate to extend beyond the bottom of the lifter assembly, thereby solving the problem of the required sufficient physical space for both the upward and bottom strokes. However, the '315 patent does not address the second and third problems that were presented by the prior art devices.

The second problem presented is that these lifter assemblies are used in very dirty environments, and any shavings, weld flash, or the like which are the by-products of the manufacturing operation, can become embedded directly in the bearings, scratching the cylindrical surface of the shaft, or the particles can become embedded in the lubricant used around the shafts and then be dragged into the bearings, causing great harm to the overall system. Traditionally, the lifter assemblies have taken up such a large "footprint" in the plants, that an enclosure to alleviate this problem has been impractical. The reason that the enclosure was not possible is that a constant ratio is needed for direct and constant contact between the actuating cylinder and the moving mounting plate in order to keep the closed dimension of the lifter kept at a constant, in addition to the necessity for keeping the stroke plus bearing ratio constantly engaged. Once these ratios are kept constant, the total workings of the lifter may be enclosed within a tolerably sized sheet metal guard to prevent outside contaminants from entering the enclosed space, thereby preventing harm to the inner workings. As one can imagine, it would be a real advantage to provide an enclosure over the entire unit, both in the retracted as well as the extended positions, such that the working mechanisms are protected from the working environment atmospheric impurities.

Moreover, a third problem arose in the prior art assemblies in that the conventional two post lifters actually included four posts, rather than two, to allow for the size of the lifter in an attempt to provide a sure and direct path for the shafts to permit reliable lifting and positioning of the workpiece. It would be a great advantage to the art to be able to actually only have two posts in a "two post" lifter as additional costs to the customer would be alleviated. The prior art four post "two post" lifters needed all four posts in order to have the two additional guide posts or shafts to allow for the size of the lifter in a closed state to be contained in the least amount of space. Furthermore, the additional posts or shafts were necessary to prevent deflection in position and path because the first set of shafts did not support the cylinder in the extended position. The additional number of shafts merely added to the problem of environment dirt contamination because there were twice as many shafts that could have problems.

Therefore, it would be a great advantage to the compact lifter if a new compact lifter could be discovered that would alleviate the space problem, prevent contaminants from entering the machinery, and merely utilize two posts, rather than four or six, for a "two post" lifter.

SUMMARY OF THE INVENTION

The present invention seeks to address these three problems while providing additional reliability of the lifting operation itself, and substantially eliminating any deviation from the position from time to time. This is achieved by a double set of bearings on each of two guide shafts, or posts, in the event of a two post compact lifter, and four guide shafts or posts in the event of a four post compact lifter. Furthermore, this linear configuration allows for exterior plates to be placed around the working mechanisms such that they can be shielded from outside contaminants, including, e.g. Weld flash, dirt, dust, and other by-products of the manufacturing operation. A compact lifter made in accordance with the present invention can include a two post lifter, a four post lifter, or any number of appropriate posts for a lifter, all using these same principles. These compact lifters will produce reliable, predictable and accurate results while minimizing the cost to manufacturer, house and maintain, as well as providing the manufacturing industry with a true two post compact lifter that will extend the life of the actuating cylinder rod bearing and its seal, being protected from atmospheric impurities.

Furthermore, compact lifters of the present invention maintain a compact size relative to the stroke of the unit, and the linear relationship of the "stacking" of the bearings provide much greater repeatability than the prior art.

Moreover, due to the exterior plates promoted in the present invention, a pneumatic lock-out pin and electrically shut-off mechanism and arrangement is now possible in a new way. During maintenance of the compact lifter, a safe means is necessary to protect the maintenance workers. Prior art inventions did not have the configuration which made possible a pneumatic lock-out device, although the present invention does. The actual lock-out device and pin are the subject of my concurrently filed patent application entitled "ELECTRICAL AND PNEUMATIC LOCK-OUT DEVICE".

Other objects, advantages and applications of the present invention will become apparent to those skilled in the art. For instance, individual lifting devices may require more or fewer posts for lifting, and the advantages of the present is invention can be realized by merely including more or fewer guide posts or shafts and bearing configurations. This extension of my invention can be made by a person of ordinary skill in the art without having to perform undue experimentation. Additional embodiments of the present invention will become apparent when the following description of the best mode contemplated for practicing my invention is read in conjunction with the appendant drawings.

BRIEF DESCRIPTION OF THE DRAWINGS

The description makes reference to the appendant drawings, wherein like reference numerals refer to like elements in other figures.

DETAILED DESCRIPTION OF THE INVENTION

In accordance with the present invention, there is disclosed several embodiments of the compact lifter including two and four post lifters, although other numbers of posts, or guide shafts, could be foreseen by one of ordinary skill in the art without undue experimentation. The present invention is described in terms of the two embodiments utilizing two and four post lifters.

Figure 1:
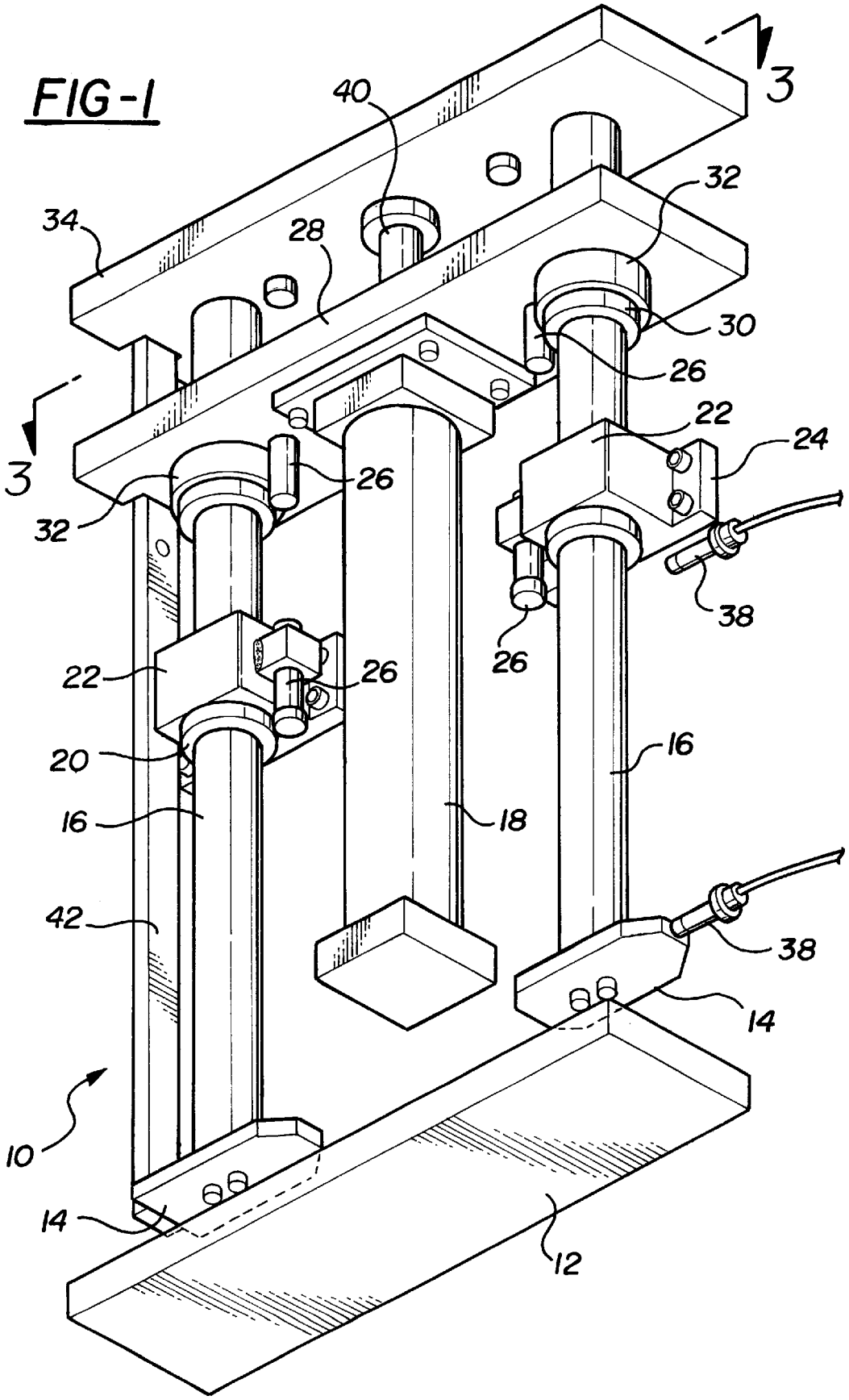
FIG. 1 is a perspective view of the two post compact lifter embodiment of the present invention in a substantially retracted position.
Figure 2:
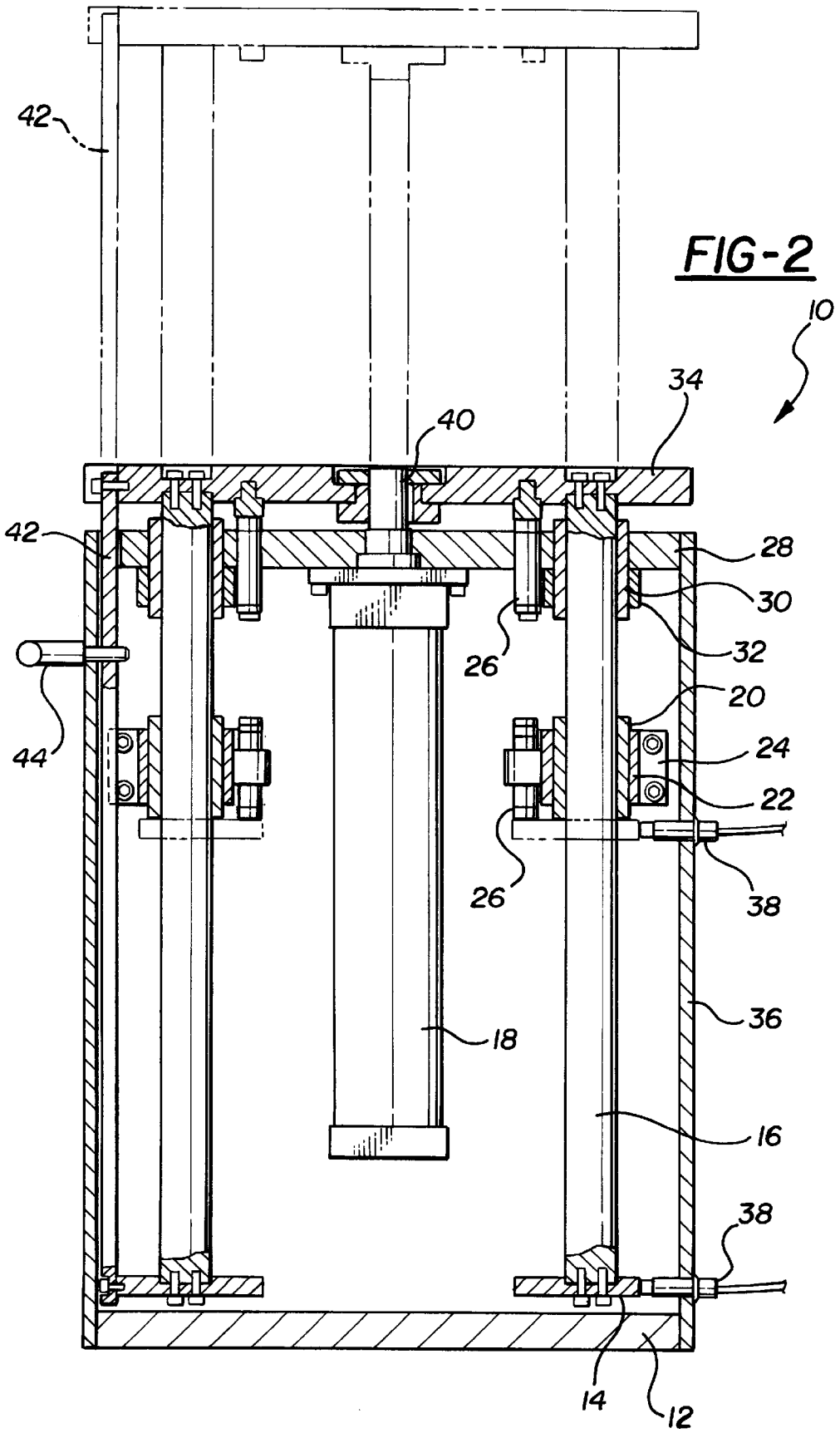
FIG. 2 is a side elevational sectional view of the two post lifter assembly in a retracted position, showing phantom lines of the compact tear in an extended position.

Referring now to FIG. 1, there is shown a two post compact lifter as generally denoted by numeral 10 including a lifting frame bottom plate 12 shown exploded from the shock stop blocks 14 for clarity, although they are attached in real life, as can be seen in FIG. 2. Shock stop blocks 14 will be described in more detail hereafter in the context of the shock absorbers. Guide shafts 16 are permanently attached to the bottom plate 12 via the shock stop blocks, although they are not necessary, as the attachment could be direct. Guide shafts 16 are received within a first pair of linear bearings 20, although any type of suitable bearing can be used prior to being received again through a second pair of linear bearings 30. Bearings 20 are located with bearing housing 22 that is secured to a back frame member (not shown here) by bearing bracket 24. A set of shock absorbers 26 is also attached to the bearing housing 22 and the bearing bracket 24 to soften the impact of the retraction of the lifter. The shock stop blocks 14 not only act as the surface onto which one set of the shock absorbers 26 lands, but the shock stop blocks 14 also act as a means for the optional proximity sensor switches 38 which tell the lifter to slow down and stop before the lifter smashes to its fully retracted position (in the event that there were no fail-safe).

Still referring to FIG. 1, there is also shown an actuating cylinder 18, common to most compact lifters, having a cylinder rod 40 extending therefrom for pushing up the platen 34. Platen 34 is the portion of lifter 10 that contacts a workpiece (not shown in the drawing) and lifts it into position for the work to be done. Actuating cylinder 18 is attached to the underside of bearing plate 28 that has a second pair of linear bearings 30 extending therethrough for receiving guide shafts 16. Again, linear bearings 30 may also be any other type of suitable bearing, but is shown in the preferred embodiment here. Guide shafts 16 extend through linear bearings 30, but are permanently attached to the underside of platen 34 in order to steady the platen and ensure its repeatable path.

The "stacked" effect of the linear bearing pairs are the reason that this compact lifter is so steady, without deviating from its path during the lifting operation. The first and second pairs of linear bearings being placed on the same guide shaft acts as a brace against movement. The distance between the two is sufficient to provide an assurance of straight movement in the extended position. Guide shafts 16 are preferably from about 1.0 inch to about 3.0 inches in diameter for most applications, although 2.0 inch diameter guide shafts are most preferably used for automotive assembly line applications.

In operation of this embodiment, actuating cylinder 18 is hydraulically operated by flexible hydraulic lines attached to the back of the cylinder (not shown in the drawing). Actuating cylinder 18 is filled with hydraulic fluid through the hydraulic lines and cylinder rod 40 is extended, pushing the platen 34 upward. Platen 34 is guided in its upward path by guide shafts 16, and the guide shafts are guided, in turn, by the first and second pair of linear bearings 20 and 30, respectively. As platen 34 is the top of a fully integrated lifter frame (the sides of which are not shown in this drawing) and bearing brackets 24 secure the bearings to the frame, the guide shaft 16 travels through the linear bearings 20, and pulls the frame and the bearing brackets upward along with it. When fully extended, and the guide shafts have traveled as far as they can go, the optional proximity sensor switch registers the location of the platen and the box frame. Then, when the compact lifter is fully retracted, the shock absorbers 26 are used in conjunction with the shock absorbers 26 to softly touch down the lifter to its retracted position, without any damage to the lifter itself or its cargo.

Even offset loads are evenly lifted by the compact lifter of the present invention, due to the "stacked" linear bearing configuration. If a part of the lifter cargo is hanging off one of the edges, the present compact lifter will still be able to reliably and positively lift the cargo into position on the assembly line.

Referring next to FIG. 2, we see a side elevational view of the compact lifter as shown in FIG. 1. Like reference numerals indicate like elements of the invention. However, in this figure, the lifter frame is shown as element 36, surrounding the entire lifter mechanism. First pair of linear bearings 20 are secured to the lifter frame 36 by bearing brackets 24 which are bolted to the frame. Second pair of linear bearings 30 are drilled through the bearing plate and secured therein by bearing sleeves 32. Although the compact lifter is shown in the retracted position, the extended position is shown in phantom for the sake of understanding.

Looking still to FIG. 2, there is a stroke bar 42 attached to the side of the lifter frame 36 so that maintenance crews have a way to lock the lift in the up or in the down position. Stroke bar 42 and lifting frame 36 both contain mating and complementary holes therein which are meant to receive a lock-out safety pin 44. Once in place inserted through both holes in the stroke bar 42 and the lifting frame 336, safety pin 44 prevents the lifter from crashing down onto a maintenance crewperson working on the lifter. Even though the electricity might be cut off, the hydraulics or pneumatics may still slip and hurt some one. Therefore, this lock-out safety pin is most helpful during maintenance of this unit.

Lifter frame 36 is difficult to show illustrated, as it completely encloses the lifter itself. Otherwise, what is actually seen from the outside of the unit, once assembled, is merely a box that moves up and down. This enclosure is the mechanism that prevents the inner workings from becoming contaminated by dirt, weld flash, or other manufacturing by-product debris.

Figure 3:
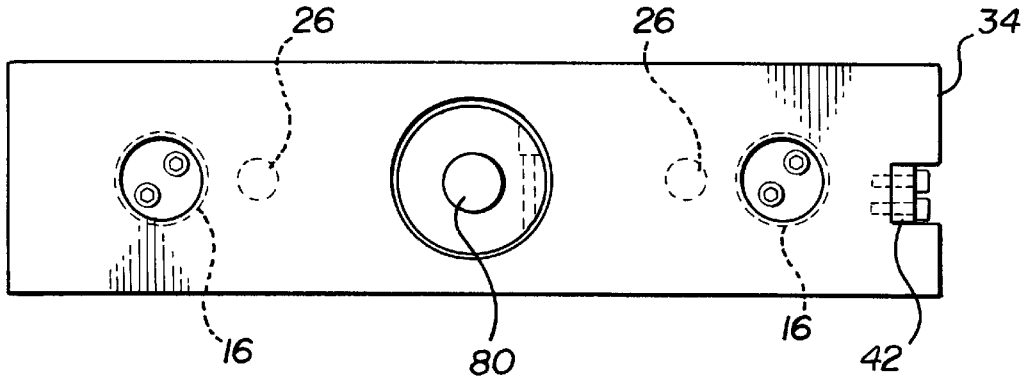
FIG. 3 is a top plan view of the two post compact lifter of FIG. 1 a view taken along lines 3—3.

FIG. 3 is the top plan view taken along line 3—3 of FIG. 1, showing the relative placement of the guide shafts 16, actuating cylinder 18, the cylinder rod 40, and the shock absorbers 26.

Figure 6:
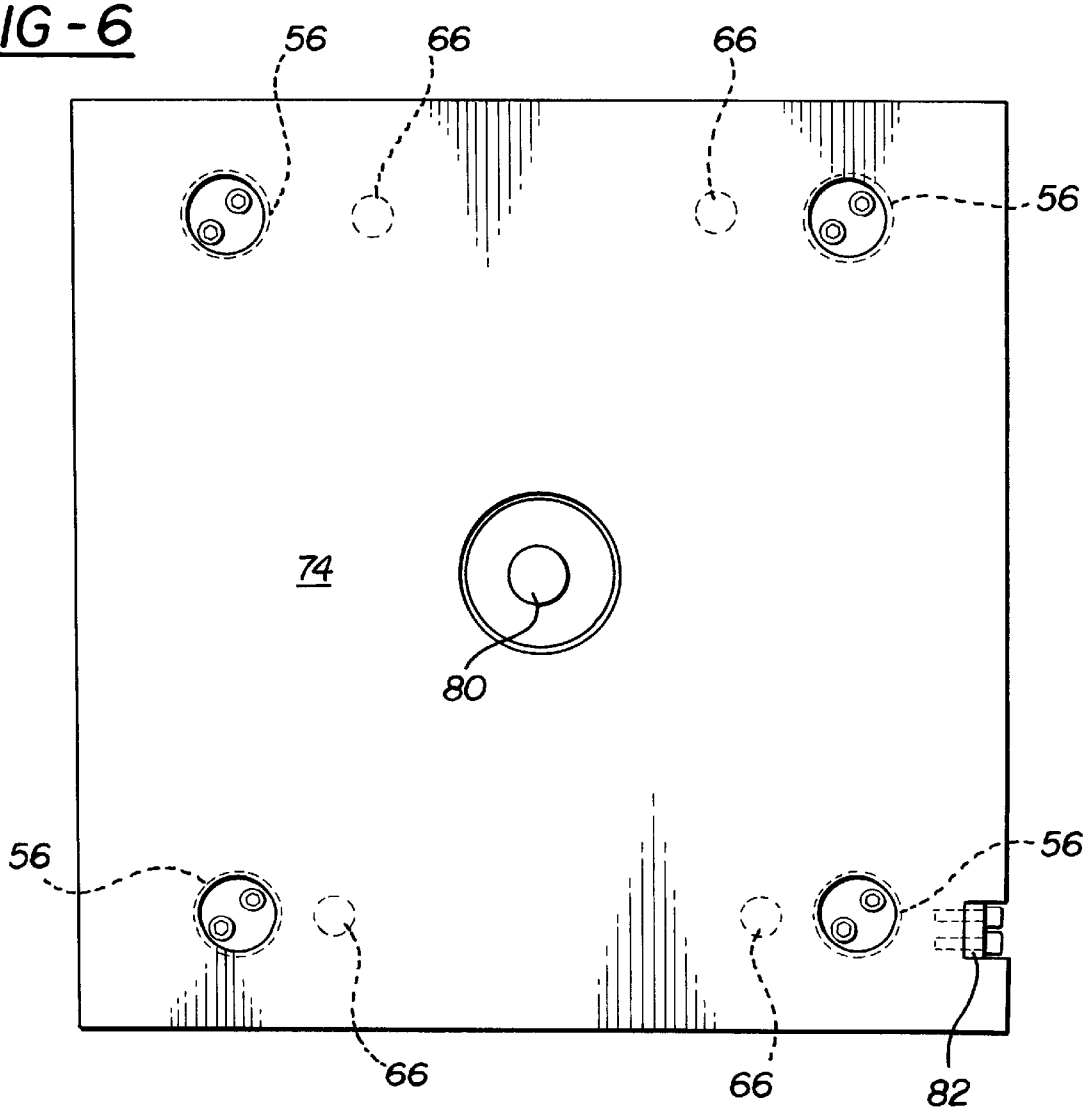
FIG. 6 is a top plan view of the four post lifter of the present invention.
Figure 4:
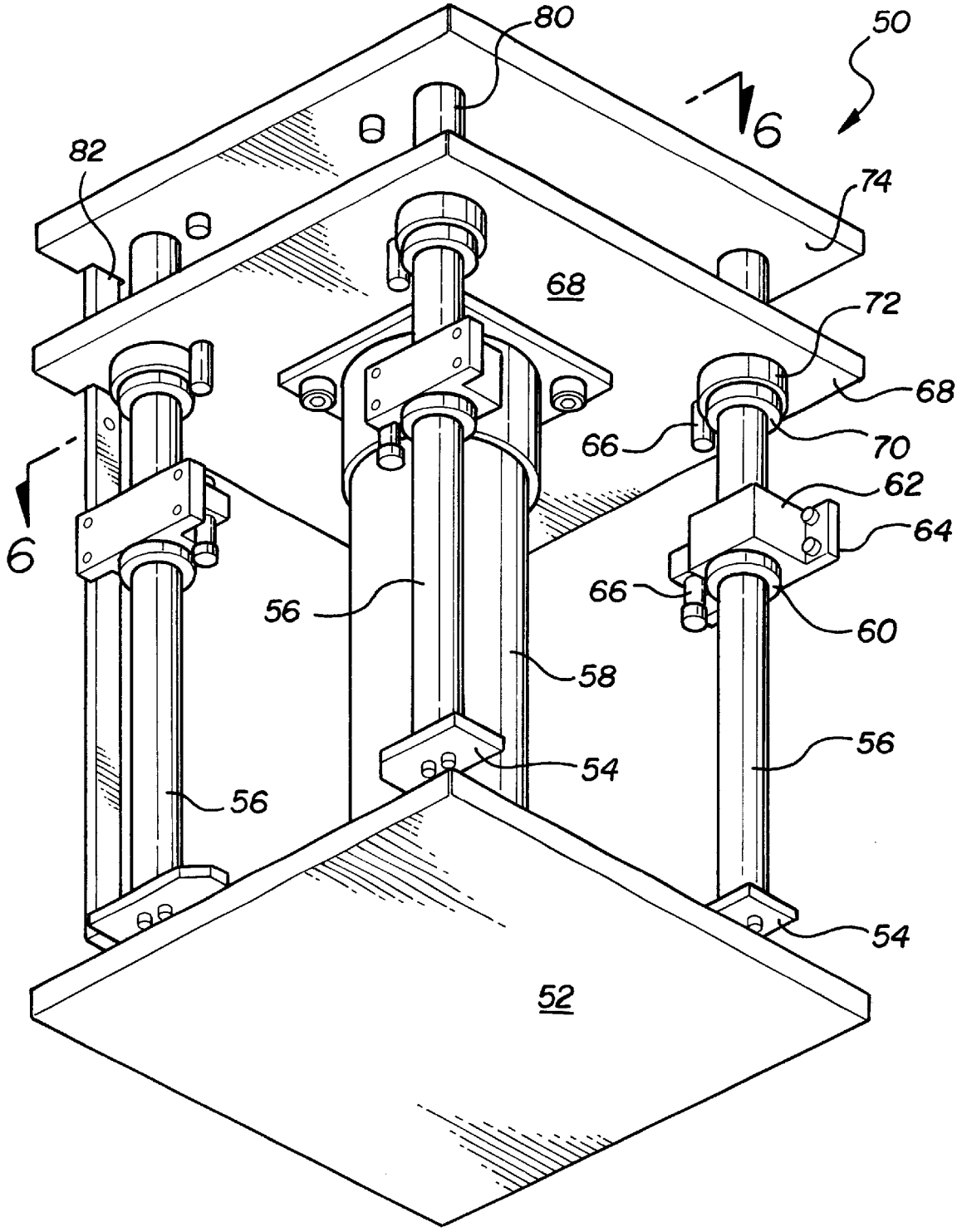
FIG. 4 is a perspective view of a four post compact lifter made in accordance with the present invention.
Figure 5:
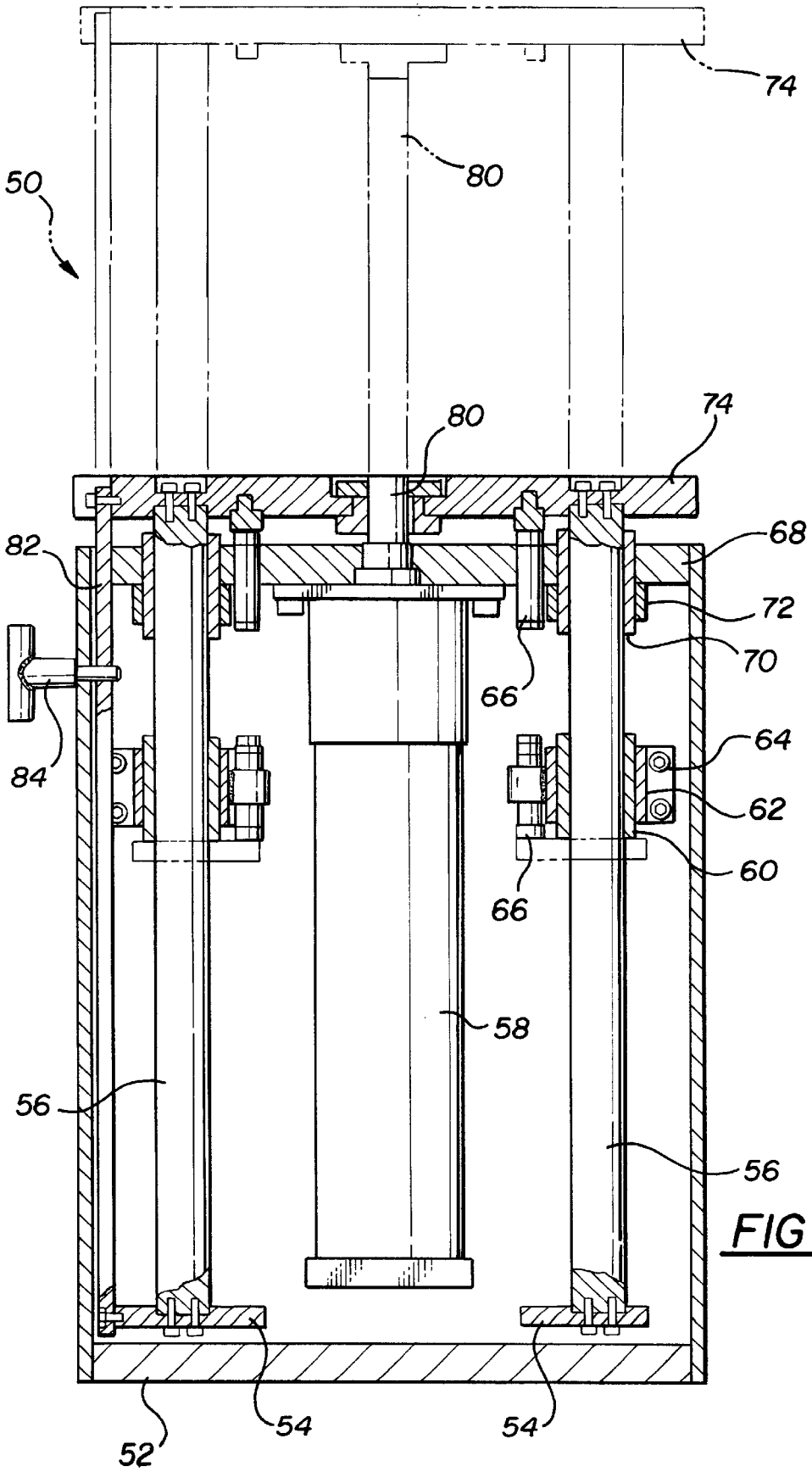
FIG. 5 is a side elevational sectional view of the four post lifter of FIG. 4.

With combined reference, we now turn to FIGS. 4–6, where there is shown the other embodiment of the present invention, that being a four poster compact lifter generally denoted by numeral 50. Again, like reference numerals refer to like elements in all the FIGS. 4–6. Lifter 50 includes a lifting frame bottom plate 52 attached to shock stop blocks 54, and is permanently attached to guide shafts 56 at both ends. An actuating cylinder 58 is utilized much the same way the actuating cylinder 18 is used in FIG. 1. The first pair of linear bearings 60 direct the guide shafts 56 in conjunction with the second pair of linear bearings 70 to reliably and reproducible operate the lifter. First and second pairs of linear bearings are housed by bearing housings 62 and 72, respectively. Shock absorbers 66 are secured to the bearing brackets 64 which are attached to the lifter frame 76, again for softening the "touchdown" of the lifter. Optional proximity sensor switches 78 (not shown in FIG. 4) work in conjunction with the shock absorbers to carefully touch down the lifter without damage to itself or its cargo. Cylinder rod 80 extends to lift the platen upwardly with its cargo into the desired position.

Further, as shown, the stroke bar 82 can be locked in place with respect to lifter frame 76 with a lock-out safety pin 84 as shown in FIG. 5. As discussed earlier with respect to FIG. 2, the safety pin acts to prevent any unwanted pneumatic or hydraulic action of the lifter when maintenance crews are working in the frame.

As for the operation of the four post lifter illustrated in FIGS. 4–6, the reader is referred to discussions hereinabove as again, this unit works very similarly to the two post lifter shown and described in great detail with respect to FIGS. 1 and 2. Most of the discussion for FIGS. 1 and 2 directly applies to FIGS. 4–6, and consequently will not be repeated in the interests of brevity.

Therefore, a compact lifter meeting and exceeding the advantages desired as described above is disclosed herein. The two post lifter is actually a two post unit which provides an extremely reliable and reproducible path for the platen and its cargo to travel, one without deviation from the desired travel path. The four post lifter exhibits similar advantages as the two post lifter. The shop floor "footprint" of the present invention is smaller than the prior art devices, and not only does not sacrifice reliability but rather surpasses the prior art devices in sturdiness and lack of deviation from the intended path. Furthermore, the entire internal mechanics are protected from environmental contaminants such as dirt, debris and weld flash, thereby reducing or eliminating down time for maintenance. Once maintenance is required, the present invention is of such a configuration that the maintenance crew can safely and easily perform the maintenance procedures without the fear of unwanted movement of the lifter, as it will be locked into a single position, without the ability to move.

While the present invention has been described with reference to two specific embodiments, it must be realized by those of ordinary skill in the art that these embodiments shall not limit the scope of the present invention. Rather, the invention is only limited by the appending claims.

What I am claiming is:

1. A compact lifter for lifting cargo and other loads to an elevated height, comprising:

a base plate for supplying support to the compact lifter during operation, a lifting platen atop the compact lifter for carrying the cargo to the elevated height;

an actuating cylinder attached to the lifting platen for extending the lifting platen upwardly to its desired height and location;

at least a pair of guide shafts permanently attached to the lifting platen and also permanently attached to and extending upwardly from the base plate;

a bearing plate sized similar to the lifting platen and being oriented in a substantially parallel fashion to the lifting platen;

at least one first set of bearings surrounding each of the guide shafts, said first set of bearings being permanently attached to and received within said bearing plate by bearing housings, wherein the guide shafts are slidably extending through and connected to the bearing plate; and at least one second set of bearings surrounding each of the guide shafts in a position downward from the first set of bearings, said second set of bearings also receiving the same guide shafts in a slidably fashion such that the individual guide shafts are now secured simultaneously by at least two sets of bearings to ensure reliable travel and reproducible results;

whereby the actuating cylinder extends the lifting platen and the guide shafts direct the path of the lifting platen because they are permanently attached thereto, and they are being held in a perfect position by at least the two sets of bearings on each guide shaft so that reliable and reproducible travel is repeatedly experienced.

2. The compact lifter of claim 1, wherein the base plate is the bottom plate of an entire enclosure for the compact lifter, such that the lifter is contained in an enclosure so that environmental contaminants do not enter into the bearings or actuating cylinder.

3. The compact lifter of claim 2, wherein the enclosure is made of sheet metal top, bottom, and side plates welded together over the lifter.

4. The compact lifter of claim 3, wherein the at least one second set of bearings is permanently attached to the sheet metal enclosure plates.

5. The compact lifter of claim 1, wherein the lifting platen is the top plate of an entire enclosure for the compact lifter.

6. The compact lifter of claim 1, wherein the at least one pair of guide shafts is made of chrome plated hard steel cylindrical rods.

7. The compact lifter of claim 1, wherein the bearing plate is located intermediate to the lifting platen and the base plate with the guide shafts sliding therethrough.

8. The compact lifter of claim 1, wherein the actuating cylinder is powered hydraulically.

9. The compact lifter of claim 1, wherein the actuating cylinder is powered pneumatically.

10. The compact lifter of claim 1, further comprising shock absorbers for reducing the shock to the lifting platen and its cargo when retraction occurs.

11. The compact lifter of claim 1, further comprising proximity sensor switches for slowing down the retraction of the lifter.

12. The compact lifter of claim 1, wherein the first and second set of bearings are linear bearings.

13. The compact lifter of claim 1, wherein the first and second set of bearings are roller bearings.

14. The compact lifter of claim 2, further comprising a stroke bar located next to the exterior reaches of the lifter, said stroke bar having a lock-out hole drilled therein for receiving a lock-out safety pin extending therethrough and into a complementary lock-out drilled hole in the lifter frame.

15. The compact lifter of claim 1, wherein the compact lifter includes two posts or shafts.

16. The compact lifter of claim 1, wherein the compact lifter includes four posts or shafts.

* * * * *